US011572756B2

(12) United States Patent
Dhamodaran et al.

(10) Patent No.: US 11,572,756 B2
(45) Date of Patent: Feb. 7, 2023

(54) ROTATIONAL DRIVE SYSTEM FOR A BLOWOUT PREVENTER

(71) Applicant: Cameron International Corporation, Houston, TX (US)

(72) Inventors: Dinesh Kumar Dhamodaran, Coimbatore (IN); Michael Raymond Netecke, Spring, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 16 days.

(21) Appl. No.: 16/891,742

(22) Filed: Jun. 3, 2020

(65) Prior Publication Data

US 2021/0381332 A1 Dec. 9, 2021

(51) Int. Cl.
*E21B 33/06* (2006.01)
*E21B 33/064* (2006.01)

(52) U.S. Cl.
CPC ..... *E21B 33/062* (2013.01); *E21B 33/064* (2013.01)

(58) Field of Classification Search
USPC ..... 251/1.1, 1.2, 1.3
See application file for complete search history.

(56) References Cited

U.S. PATENT DOCUMENTS 2,154,955 A * 4/1939 Mueller ..... E21B 33/062 251/1.3
2,860,266 A * 11/1958 Schrader ..... F16K 31/046 310/112
3,416,767 A * 12/1968 Blagg ..... E21B 33/072 251/1.3
3,791,616 A * 2/1974 Le Rouax ..... E21B 33/062 251/1.3
3,967,542 A 7/1976 Hall et al.
4,964,610 A * 10/1990 Wong ..... E21B 33/062 251/1.3
5,505,426 A * 4/1996 Whitby ..... E21B 33/062 251/1.1

(Continued)

FOREIGN PATENT DOCUMENTS

CN 207111033 U 3/2018
KR 20-2017-0002085 U 6/2017
WO 2019213041 A1 11/2019

OTHER PUBLICATIONS

International Search Report and Written Opinion issued in International Patent application PCT/US2021/032916 dated Aug. 30, 2021; 10 pages.

*Primary Examiner* — Daphne M Barry
(74) *Attorney, Agent, or Firm* — Kelly McKinney

(57) ABSTRACT

The present disclosure relates to a drive system for a blowout preventer (BOP). The drive system includes a first pseudo direct drive (PDD) motor assembly having a first PDD motor and a second PDD motor assembly having a second PDD motor. The first PDD motor is configured to engage with a first shaft coupled to a first ram of the BOP and the second PDD motor is configured to engage with a second shaft coupled to a second ram of the BOP. The first PDD motor and the second PDD motor are operable to induce translation of the first shaft and the second shaft, respectively, to drive the first ram and the second ram toward one another along a longitudinal axis to reach an engaged configuration in the BOP.

18 Claims, 10 Drawing Sheets

(56) References Cited

U.S. PATENT DOCUMENTS

| | | | | |
|---|---|---|---|---|
| 5,784,922 | A * | 7/1998 | Ozaki | H02K 7/06 74/89.37 |
| 7,025,322 | B2 | 4/2006 | Biester | |
| 7,798,466 | B2 * | 9/2010 | Springett | E21B 33/062 251/1.3 |
| 7,969,044 | B2 | 6/2011 | Armstrong et al. | |
| 8,283,879 | B2 | 10/2012 | Liu et al. | |
| 8,541,909 | B2 | 9/2013 | Armstrong et al. | |
| 9,322,230 | B2 | 4/2016 | Talamo et al. | |
| 9,816,592 | B1 | 11/2017 | Glikin et al. | |
| 9,927,032 | B2 | 3/2018 | Grover | |
| 2008/0048139 | A1 * | 2/2008 | Whitby | E21B 33/062 251/1.3 |
| 2008/0135291 | A1 * | 6/2008 | Hall | E21B 21/08 175/25 |
| 2013/0134815 | A1 * | 5/2013 | Powell | H02K 16/02 310/101 |
| 2014/0033842 | A1 * | 2/2014 | Morin | F16H 37/041 74/89.17 |
| 2014/0069531 | A1 * | 3/2014 | Jaffrey | E21B 33/076 137/553 |
| 2015/0300848 | A1 * | 10/2015 | Campbell | G01N 27/72 29/592.1 |
| 2016/0053912 | A1 * | 2/2016 | Lenz | F16K 31/047 251/129.01 |
| 2019/0032806 | A1 | 1/2019 | Eriksen | |
| 2020/0217166 | A1 * | 7/2020 | Arteaga | E21B 33/062 |
| 2021/0230960 | A1 * | 7/2021 | Al-Mousa | E21B 17/006 |

* cited by examiner

ROTATIONAL DRIVE SYSTEM FOR A BLOWOUT PREVENTER

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) stack may be installed on a wellhead to seal and control a well during drilling, well-logging, and/or other operations performed on a geological formation. For example, during drilling operations, a drill string may be suspended inside a drilling riser and extend through the BOP stack into the wellhead. The drill string may include equipment, such as a drilling bit, which enables removal of material from the geological formation to facilitate formation of a wellbore. Alternatively, during well-logging operations, a cable (e.g., a wireline cable) may extend through the drilling riser and the BOP stack and may couple to a downhole tool disposed within the wellbore. The downhole tool may include measurement tools and/or sensors for measuring characteristics of a fluid within the wellbore and/or characteristics of the geological formation. In the event of a rapid invasion or formation of fluid in the wellbore, commonly known as a "kick," rams of the BOP stack may be actuated to isolate the drilling riser from the wellhead to protect well equipment disposed above the BOP stack.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
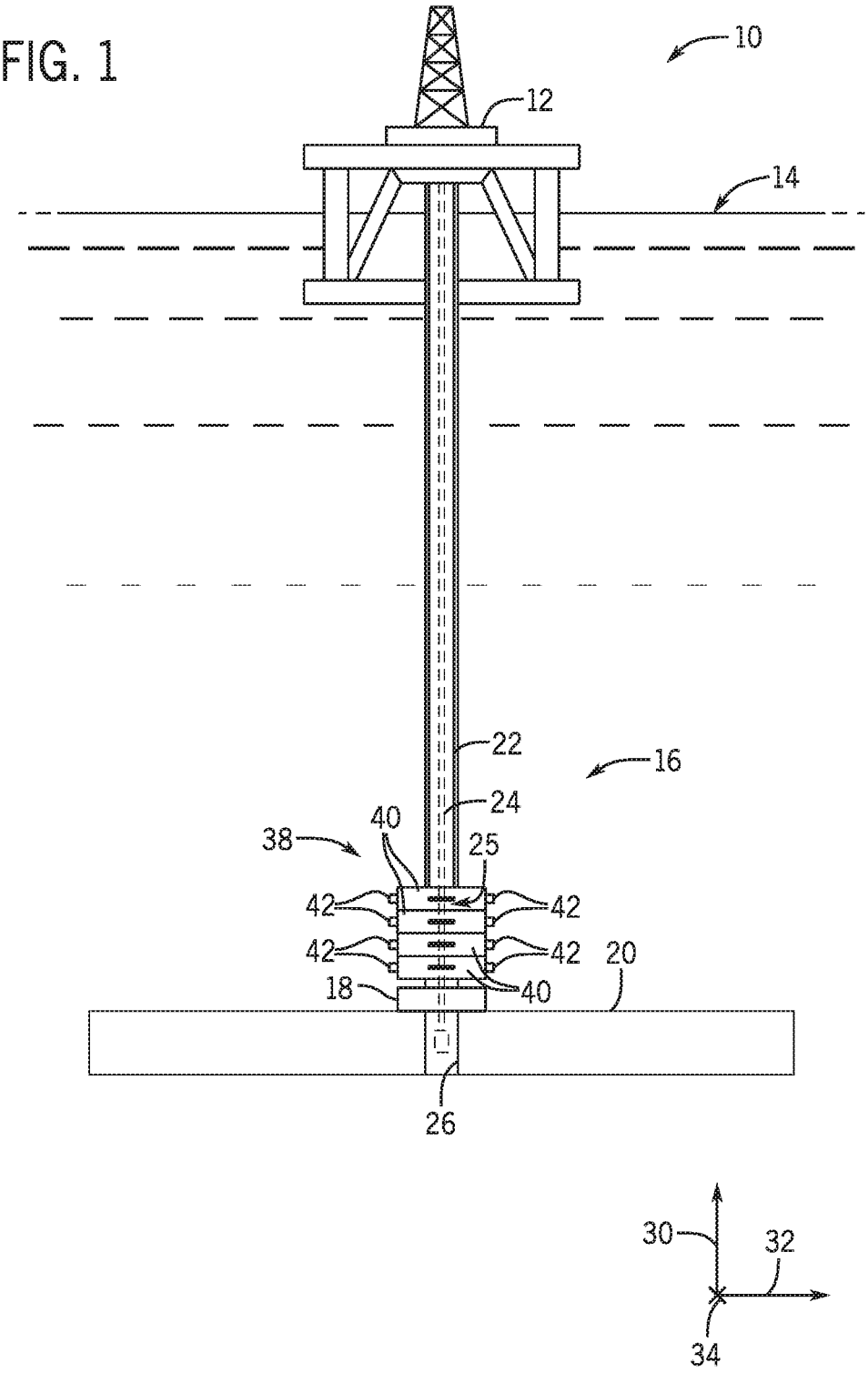
FIG. 1 is a schematic diagram of a drilling system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components. Numerical terms, such as "first," "second," and "third" are used to distinguish components to facilitate discussion, and it should be noted that the numerical terms may be used differently or assigned to different elements in the claims.

A blowout preventer (BOP) system may be included at a wellhead to block a fluid from inadvertently flowing from the wellhead to a drilling platform (e.g., through a drilling riser). For example, pressures may fluctuate within a natural fluid reservoir (e.g., an oil and/or natural gas reservoir), which may lead to a surge in fluid flow from the wellhead toward the drilling platform when the pressure reaches a threshold value. To block fluid from flowing toward the drilling platform during a kick and/or a blowout condition, the BOP system may be actuated to cover or seal a bore in the BOP system that fluidly couples the wellhead to the drilling riser. The BOP system may include rams (e.g., pipe rams, blind rams, shear rams) that are actuated to seal the bore, such as by engaging (e.g., contact and/or cut) a tubular (e.g., drill string, wireline, cable) disposed in the bore to facilitate sealing of the bore (e.g., blocking fluid flow through the bore).

Embodiments of the present disclosure are directed toward a BOP system that enables more reliable and precise control of the rams during performance of shearing and/or sealing operations (e.g., as compared to some existing BOP systems, which use hydraulic cylinders to actuate the rams). In the BOP system, one or more electric motor assemblies, such as one or more pseudo direct drive (PDD) motor assemblies having PDD motors with integral magnetic gearing (e.g., PDD motors manufactured by Magnomatics), are coupled to a housing of the BOP system and are configured to actuate (e.g., move) corresponding rams of the BOP system between default (e.g., open) and engaged (e.g., closed) positions or configurations.

The BOP system may include multiple sets of rams, and each set of rams may include an upper ram (e.g., a first ram) and a lower ram (e.g., a second ram). The upper ram, the lower ram, or both, may be coupled to a respective PDD motor assembly via a shaft (e.g., a ball screw). Each of the PDD motor assemblies includes a rotor that is configured to rotate about an axis, relative to shaft. The rotor may be coupled to a respective motion conversion mechanism (e.g., a ball screw assembly) that is configured to convert rotational motion of the rotor (e.g., about the axis) into longitudinal movement of the shaft (e.g., along the axis). The motion conversion mechanism thus enables the PDD motor to force the shaft and corresponding ram relative to the housing of the BOP system. In this manner, the PDD motor assemblies may be used to transition the upper and lower rams between the default configurations, in which the rams unblock a bore of the housing, and the engaged configurations, in which the rams extend across the bore to shear a tubular disposed within the bore and/or to seal the bore.

The BOP system enables operation of the BOP system without utilization of dedicated hydraulic cylinder assemblies to move the rams between the default and engaged configurations. Being devoid of such hydraulic cylinders may reduce a manufacturing cost and/or a manufacturing complexity of the BOP system, as well as improve an operational reliability of the BOP system. For example, utilization of the PDD motor assemblies in the BOP system may enable operation of the BOP system without various hydraulic lines, fluid reservoirs, pumps, and/or other costly hydraulic components that may be prone to developing fluid leaks or incurring performance degradation over time.

Additionally, as discussed in detail below, the BOP system may enable a position of each of the rams to be more precisely monitored and controlled during operation of the BOP system (e.g., as compared to some existing BOP systems that utilize hydraulic cylinders to actuate the rams). For example, in some embodiments, each of the PDD motors may be equipped with an encoder or other sensor that is configured to monitor a rotational position of the rotor (e.g., with respect to an initial or baseline position of the rotor). The encoder may provide a controller of the BOP system with feedback indicative of the rotational position of the rotor. Because the ram is engaged with the rotor via the motion conversion mechanism, a particular rotational position of the rotor may correspond to a particular axial position of the ram within the housing. Thus, the controller may, based on the feedback received from the encoder, determine an axial position of the ram within the housing (e.g., with respect to an initial or baseline position of the ram). The controller may be configured to adjust an operational speed, an output torque, and/or other operational parameters of the PDD motors based on the acquired sensor feedback to enhance operation of the BOP system. These and other features will be described below with reference to the drawings.

With the foregoing in mind, FIG. 1 is a schematic of an embodiment of a drilling system 10. The drilling system 10 includes a vessel or platform 12 located at a surface 14. A BOP stack assembly 16 is mounted to a wellhead 18 at a floor 20 (e.g., a sea floor for offshore operations). A riser 22 extends from the platform 12 to the BOP stack assembly 16. The riser 22 may return drilling fluid or mud to the platform 12 during drilling operations. Downhole operations are carried out by a tubular 24 (e.g., drill string, wireline, cable) that extends from the platform 12, through the riser 22, through a bore 25 of the BOP stack assembly 16, and into a wellbore 26.

Although the drilling system 10 is shown as an offshore system in the illustrated embodiment of FIG. 1, it should be appreciated that, in other embodiments, the drilling system 10 may include a land-based drilling system or another other suitable stationary or mobile drilling system. Moreover, it should be understood that the drilling system 10 may also be used to convey a downhole well-logging tool into the wellbore 26 via a cable (e.g., a wireline cable) that is spooled or unspooled on a drum of the drilling system 10, and the tubular 24 referenced herein is intended to represent any of a wide variety of components, including the cable, that may extend through the bore 25 of the BOP stack assembly 16. As an example, the drilling system 10 may utilize the well-logging tool to acquire sensor feedback indicative of parameters of a fluid within the wellbore 26 and/or of the geological formation surrounding the wellbore 26. Furthermore, the BOP stack assembly 16 and its components may be utilized during a wide variety of other operations, including production operations.

To facilitate discussion of the BOP stack assembly 16 and its components, the BOP stack assembly 16 may be described with reference to an axial axis 30 (e.g., extending generally along the tubular 24), a longitudinal axis 32, and a lateral axis 34. The longitudinal axis 32 and the lateral axis 34 extend crosswise to the axial axis 30. For clarity, relative terms, such as, for example, axial, longitudinal, lateral, upper and lower are used throughout the following discussion to describe relative positions of various components or regions of the BOP stack assembly 16 with respect to other components or regions of the BOP stack assembly 16. As such, it should be understood that such relative terms are intended to facilitate discussion and may be dependent upon an orientation of an observer with respect to the BOP stack assembly 16 and its components.

In the illustrated embodiment, the BOP stack assembly 16 includes a BOP stack 38 having multiple BOPs 40 (e.g., ram BOPs) axially stacked (e.g., along the axial axis 30) relative to one another. As discussed in more detail below, each BOP 40 may include a pair of longitudinally opposed rams and corresponding PDD motor assemblies 42 that actuate and drive the rams toward and away from one another along the longitudinal axis 32. Although four BOPs 40 are shown in the illustrated embodiment of FIG. 1, the BOP stack 38 may include any suitable number of the BOPs 40 (e.g., 1, 2, 3, 4, 5, 6 or more than 6 BOPs 40).

Additionally, the BOP stack 38 may include any of a variety of different types of rams. For example, in certain embodiments, the BOP stack 38 may include one or more BOPs 40 having opposed shear rams or blades configured to sever the tubular 24 and seal off the wellbore 26 from the riser 22. Additionally or alternatively, the BOP stack 38 may include one or more BOPs 40 having opposed pipe rams configured to engage the tubular 24 and to seal the bore 25 (e.g., to seal an annulus around the tubular 24) without severing the tubular 24. Additionally or alternatively, the BOP stack 38 may include one or more BOPs 40 having opposed blind rams configured to seal the bore 25 while the tubular 24 is not present in the bore 25.

Figure 2:
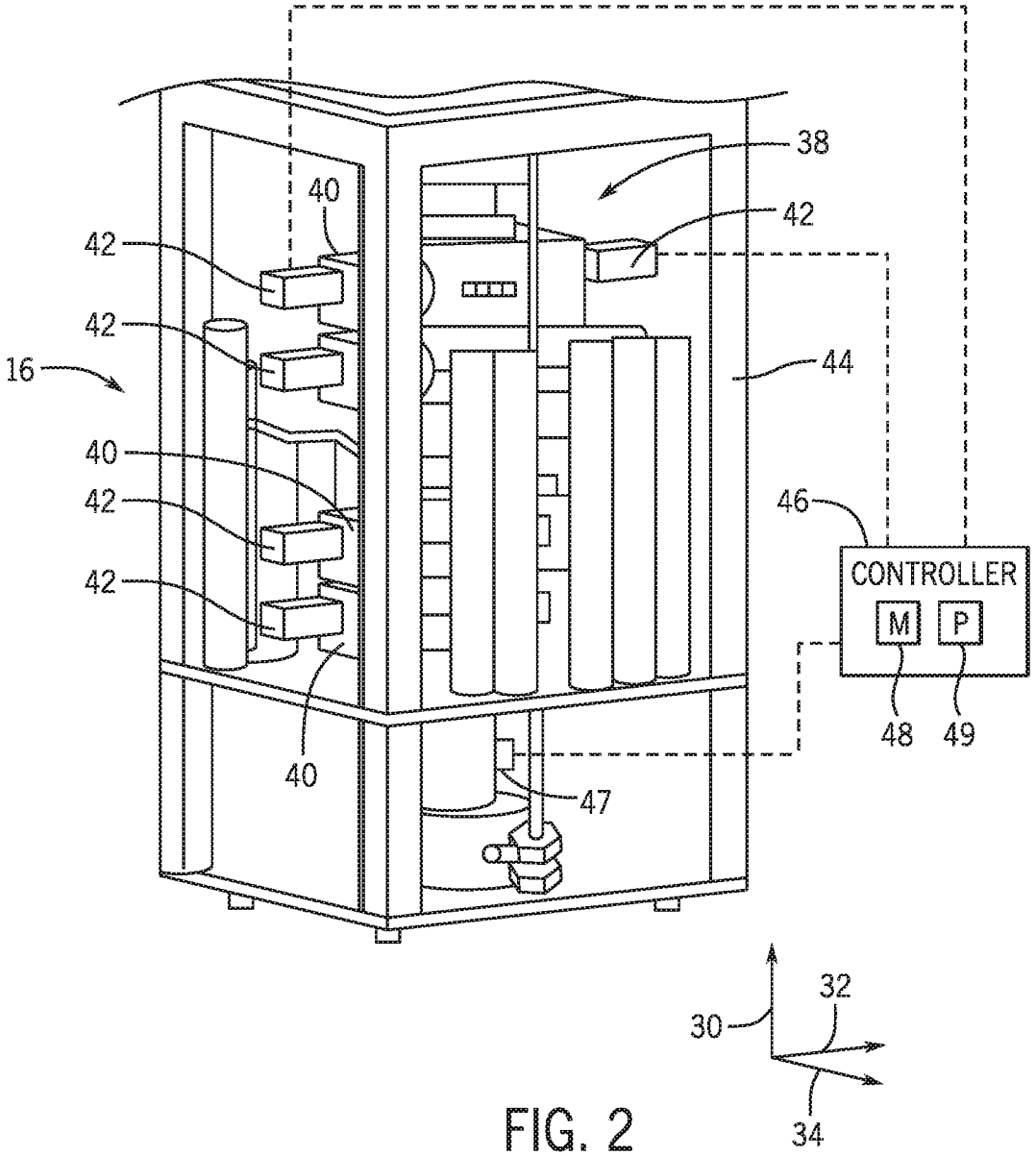
FIG. 2 is a perspective view of a blowout preventer (BOP) stack assembly that may be used in the drilling system of FIG. 1, in accordance with an embodiment of the present disclosure.

FIG. 2 is a perspective view of an embodiment of the BOP stack assembly 16. As discussed above, the BOP stack 38 includes multiple BOPs 40 axially stacked (e.g., along the axial axis 30) relative to one another. In some embodiments, the BOP stack 38 includes a frame or other support structure 44 that is configured to support the BOPs 40 and/or any other suitable components of the BOP stack 38 discussed herein. As shown in the illustrated embodiment, the PDD motor assemblies 42 may be communicatively coupled to a controller 46 of the BOP stack 38 via wired or wireless communication channels. The controller 46 may be coupled to a portion of the support structure 44 or may be positioned remote of the BOP stack 38 (e.g., on the platform 12). The controller 46 may be configured to send signals to the PDD motor assemblies 42 to drive the rams of the BOPs 40, such as when blowout conditions exist. For example, the controller 46 may receive feedback from one or more sensors 47 (e.g., pressure sensors, temperature sensors, flow sensors, vibration sensors, and/or composition sensors) that may monitor conditions of the wellbore 26 (e.g., a pressure of the fluid in the wellbore 26). The controller 46 may include a memory 48 that stores threshold values indicative of blowout conditions. Accordingly, a processor 49 of the controller 46 may send a signal instructing the PDD motor assemblies 42 to drive and/or actuate the rams to engaged or closed configurations when measured feedback received from the sensors 47 meets or exceeds such threshold values.

The processor 49 may include a microprocessor, which may execute software for controlling components of the BOP stack 38, for analyzing sensor feedback acquired by respective sensors (e.g., the one or more sensors 47) of the BOP stack 38, and/or for controlling any other suitable components of the drilling system 10. The processor 49 may include multiple microprocessors, one or more "general-purpose" microprocessors, one or more special-purpose microprocessors, and/or one or more application specific integrated circuits (ASIC), or some combination thereof. For example, the processor 49 may include one or more reduced instruction set computer (RISC) processors. The memory 48 may include volatile memory, such as random access memory (RAM), and/or nonvolatile memory, such as read-only memory (ROM). The memory 48 may store information, such as control software (e.g., control algorithms for controlling the BOP stack 38), look up tables, configuration data, communication protocols, etc.

For example, the memory 48 may store processor-executable instructions including firmware or software for the processor 49 to execute, such as instructions for controlling any of the components of the BOP stack 38 discussed herein and/or for controlling other suitable components of the drilling system 10. In some embodiments, the memory 48 is a tangible, non-transitory, machine-readable media that may store machine-readable instructions for the processor 49 to execute. The memory 48 may include ROM, flash memory, hard drives, any other suitable optical, magnetic, or solid-state storage media, or a combination thereof.

Figure 3:
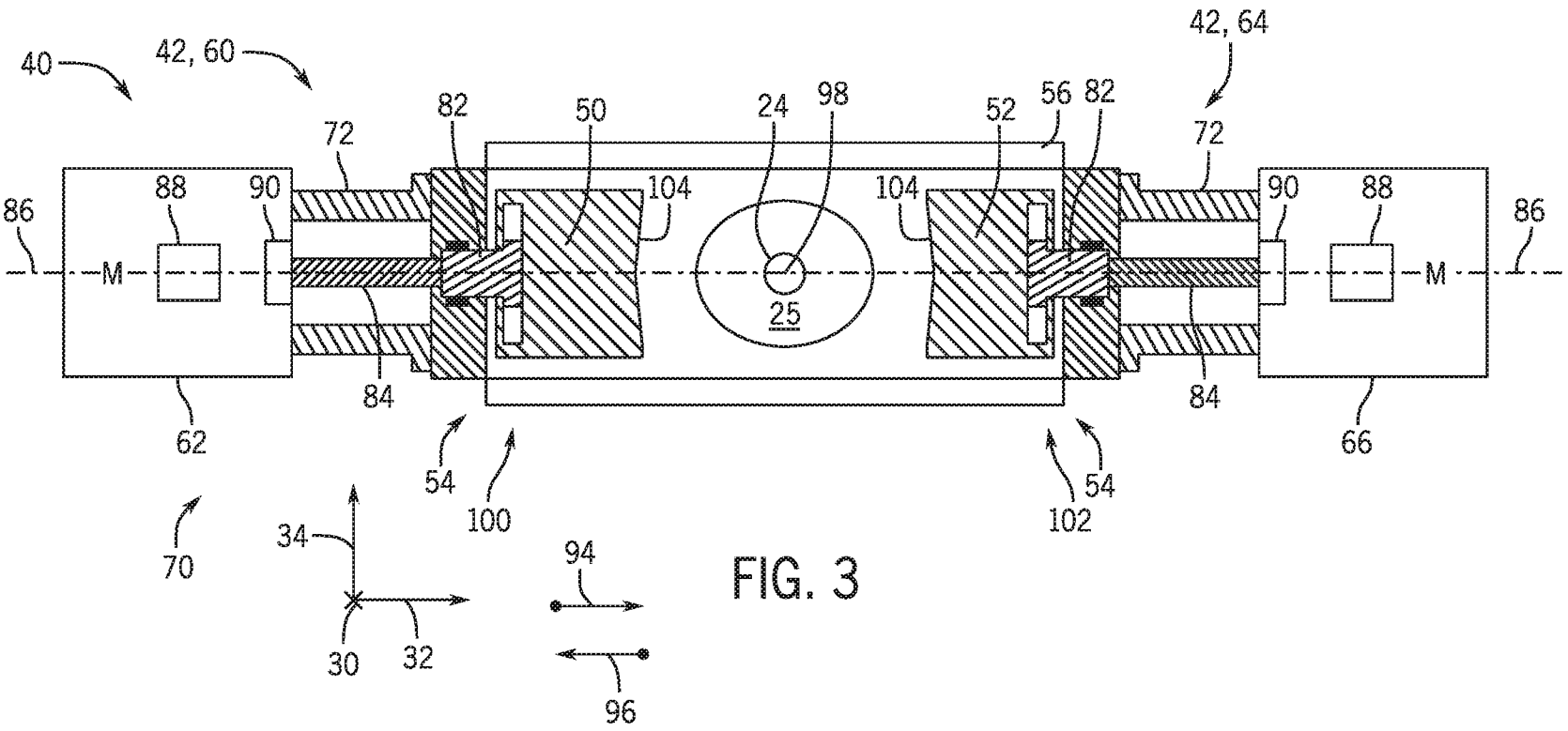
FIG. 3 is a cross-sectional top view of a portion of a BOP that may be used in the BOP stack assembly of FIG. 2, wherein a first ram and a second ram of the BOP are in default configurations, in accordance with an embodiment of the present disclosure.

FIG. 3 is a cross-sectional top view of a portion of one of the BOPs 40. The BOP 40 includes a first ram 50 (e.g., an upper ram) and a second ram 52 (e.g., a lower ram) that, in the illustrated embodiment, are positioned in respective open or default configurations 54. The first ram 50 and the second ram 52 may be collectively referred to herein as a ram system or ram assembly of the BOP 40. In the default configurations 54, the first ram 50 and the second ram 52 are withdrawn or retracted from the bore 25, do not contact the tubular 24, and/or do not contact the corresponding opposing ram 50, 52. As shown, the BOP 40 includes a housing 56 (e.g., casing) surrounding the bore 25. The housing 56 is generally rectangular in the illustrated embodiment, although the housing 56 may have any cross-sectional shape, including any polygonal shape or an annular shape.

Figure 4:
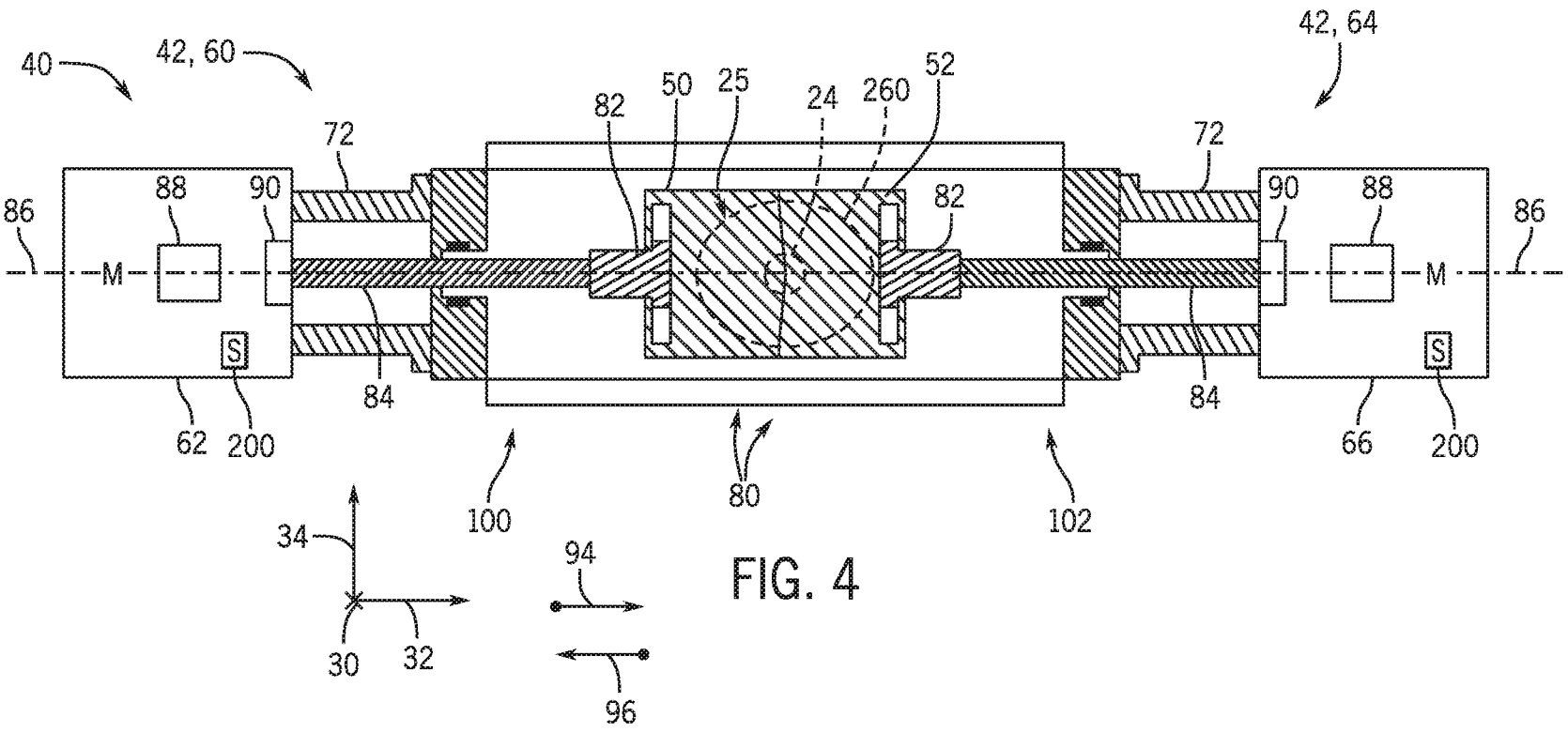
FIG. 4 is a cross-sectional top view of the portion of the BOP of FIG. 3, wherein the first ram and the second ram of the BOP are in engaged configurations, in accordance with an embodiment of the present disclosure.

In the illustrated embodiment, the BOP 40 includes a first PDD motor assembly 60 (e.g., one of the PDD motor assemblies 42) having a first PDD motor 62 and a second PDD motor assembly 64 (e.g., one of the PDD motor assemblies) having a second PDD motor 66. The first PDD motor assembly 60 and the second PDD motor assembly 64 will be collectively referred to herein as a drive system 70 of the BOP 40. The first and second PDD motor assemblies 60, 64 include respective mounting assemblies 72 (e.g., support structures) that facilitate mounting (e.g., via threaded fasteners) the first and second PDD motors 62, 66 to the housing 56. In some embodiments, the first and second PDD motor assemblies 60, 62 may be disposed on diametrically opposite sides of the housing 56. As discussed in detail herein, the PDD motor assemblies 42 are operable to drive axial movement of the first and second rams 50, 52 along the longitudinal axis 32. Particularly, the PDD motor assemblies 42 are operable to drive the rams 50, 52 between the default configurations 54 and respective engaged configurations 80 (e.g., as shown in FIG. 4), in which the rams 50, 52 may cover and/or seal the bore 25 and/or sever (e.g., cut) the tubular 24.

In the illustrated embodiment, a respective piston button 82 is coupled to the first ram 50 and the second ram 52. Shafts 84 (e.g., threaded rods, ball screws, lead screws) extend between the piston buttons 82 and the first and second PDD motors 62, 66. Each of the shafts 84 may extend along an axis 86 (e.g., central axis; axis of rotation) that is generally parallel to the longitudinal axis 32. The first and second PDD motors 62, 66 each include a rotor 88 or rotor assembly that is configured to rotate circumferentially about the axis 86. The rotors 88 may be coupled to respective motion conversion mechanisms 90 (e.g., ball screw assemblies) that are configured to engage with the shafts 84 to convert rotational motion of the rotors 88 (e.g., about the axis 86) to axial movement of the shafts 84 (e.g., along the axis 86). As such, during shearing and/or sealing operations of the BOP 40, the first PDD motor 62 may be operable to drive the correspond shaft 84 and the first ram 50 in a first direction 94 along the axis 86 (e.g., toward the tubular 24) and the second PDD motor 66 may be operable to drive the corresponding shaft 84 and the second ram 52 in a second direction 96 along the axis 86, opposite the first direction 94. To this end, the PDD motor assemblies 42 may be used to transition the first and second rams 50, 52 between the default configurations 54, in which the rams 50, 52 may uncover (e.g., unblock) the bore 25, and the engaged configurations 80, in which the rams 50, 52 may cover (e.g., block) the bore 25 and/or sever the tubular 24. In some embodiments, the axis 86 may extend generally orthogonal or crosswise to a central axis 98 (which is generally parallel to the axial axis 32) of the tubular 24.

As shown in the illustrated embodiment of FIG. 3, when in the default configuration 54, the first ram 50 is generally adjacent to a first end 100 of the housing 56 and the second ram 52 is generally adjacent to a second end 102, opposite the first end 100, of the housing 56. In some embodiments, the first ram 50 and/or the second ram 52 may include a blade 104 that enables the rams 50, 52 to more effectively cut or sever the tubular 24 during shearing operations. While the illustrated embodiment of FIG. 3 shows the first and second rams 50, 52 as shearing rams, embodiments of the present disclosure may be applied to any suitable type of ram BOP (e.g., a pipe ram BOP; a blind ram BOP).

Figure 5:
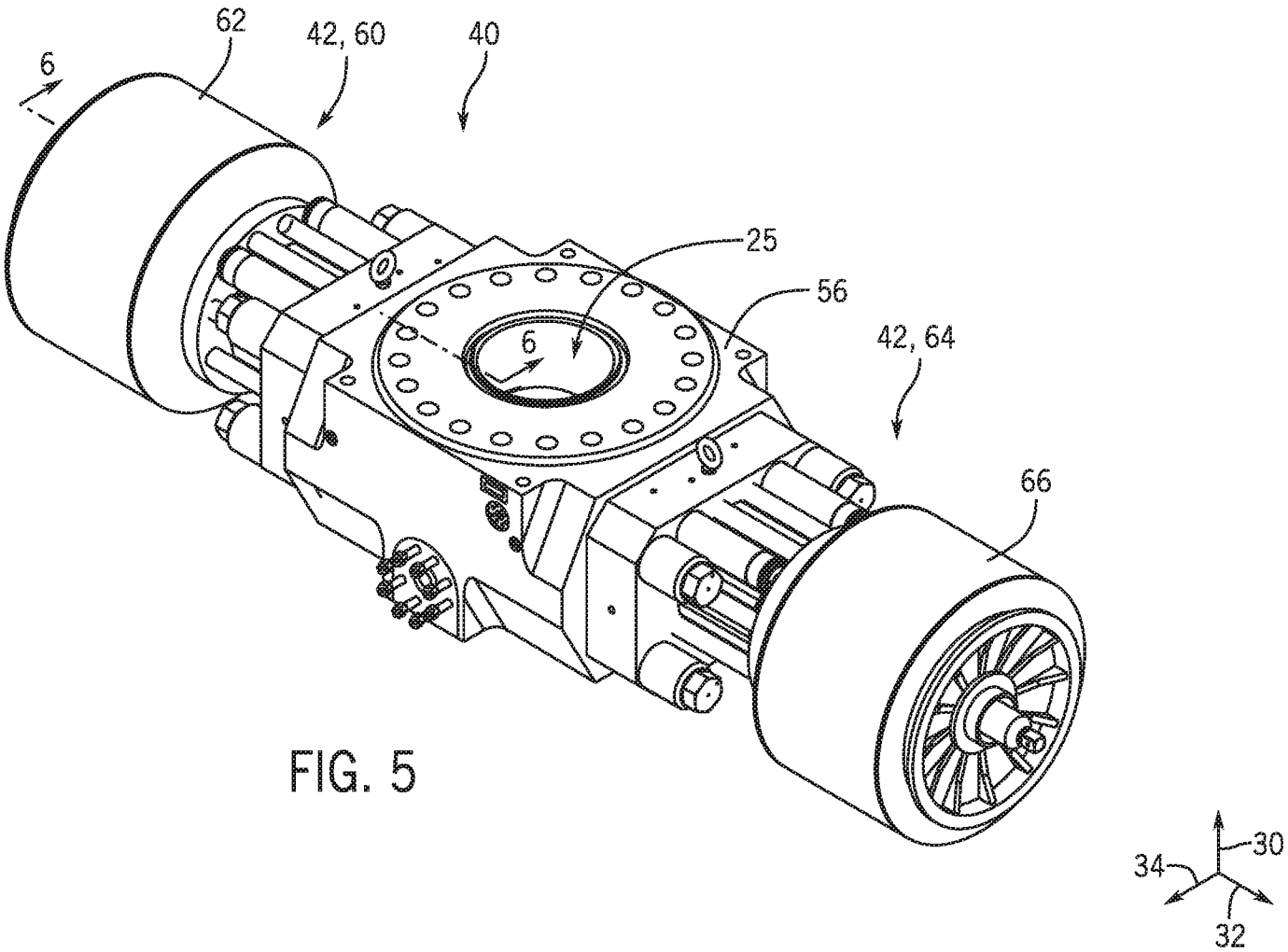
FIG. 5 is a perspective view of the BOP that may be used in the BOP stack assembly of FIG. 2, wherein the BOP includes a first pseudo direct drive (PDD) motor assembly and a second PDD motor assembly configured to drive operation of the first ram and the second ram, in accordance with an embodiment of the present disclosure.
Figure 6:
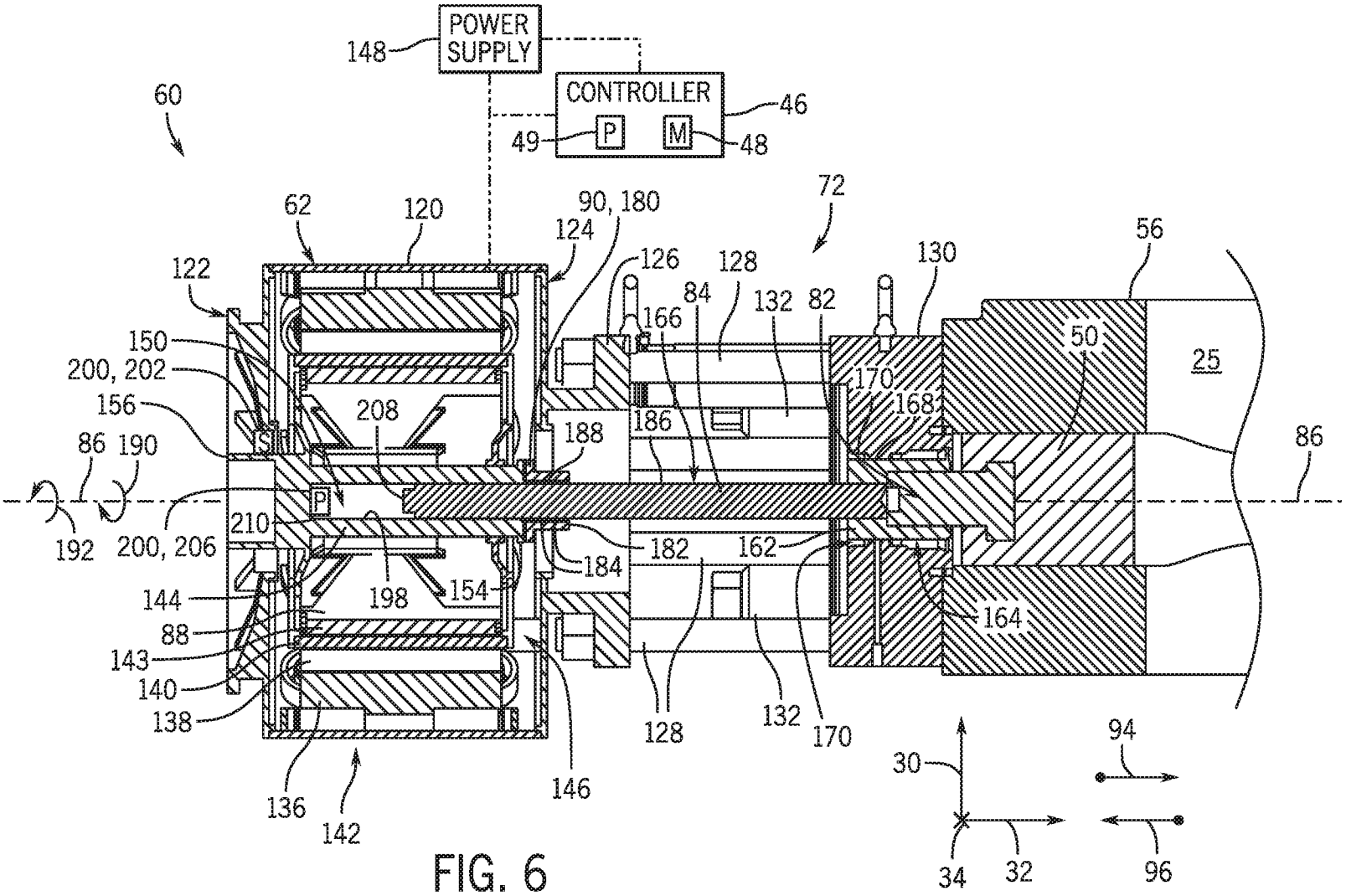
FIG. 6 is a cross-sectional side view of the first PDD motor assembly of FIG. 5 taken along line 6-6 of FIG. 5, in accordance with an embodiment of the present disclosure.

FIG. 5 is a perspective view of an embodiment of the BOP 40, which includes the first PDD motor assembly 60 and the second PDD motor assembly 64. To better illustrate one of the PDD motor assemblies 42 and to facilitate the following discussion, FIG. 6 is a cross-sectional view of an embodiment of the first PDD motor assembly 60 taken along line 6-6 of FIG. 5. It should be understood that the second PDD motor assembly 64 may include some of or all of the features of the first PDD motor assembly 60 discussed herein.

As shown in the illustrated embodiment of FIG. 6, the first PDD motor 62 includes a motor housing 120 having a first end portion 122 and a second end portion 124, opposite the first end portion 122. In some embodiments, a flange 126 may extend from and/or be formed integrally with the second end portion 124 of the motor housing 120. The mounting assembly 72 may include a plurality of fasteners 128 (e.g., bolts) that facilitate removably coupling the flange 126 to a bracket 130 of the mounting assembly 72. The bracket 130 may be coupled to the housing 56 of the BOP 40, such as via additional fasteners 132 (e.g., bolts). As such, the mounting assembly 72 ensures that the motor housing 120 remains substantially stationary relative to the housing 56 during operation of the BOP 40.

In the illustrated embodiment, the first PDD motor 62 includes a stator 136, stator magnets 138, and a pole piece rotor (PPR) 140, which extend circumferentially about the axis 86. The stator 136, the stator magnet 138, and the PPR 140 will be collectively referred to herein as a drive assembly 142 of the first PDD motor 62. The first PDD motor 62 includes the rotor 88 and a series of rotor magnets 143 that are disposed within the drive assembly 142 and circumferentially about the axis 86. The rotor 88 may be coupled to or formed integrally with an output shaft 144 of the first PDD motor 62. The rotor 88, the rotor magnets 143, and the output shaft 144 will be collectively referred to herein as a rotor assembly 146 of the first PDD motor 62.

In some embodiments, the drive assembly 142 may be electrically coupled to a suitable power supply 148 that is configured to supply the drive assembly 142 with electrical power. The power supply 148 enables the drive assembly 142 to induce rotation of the rotor assembly 146 circumferentially about the axis 86 (e.g., via generation of magnetic fields). The controller 46 may be configured to regulate supply of electrical power to the drive assembly 142 to adjust a rotational speed of the rotor assembly 146 (e.g., about the axis 86) and/or to adjust a torque output of the rotor assembly 146. As a non-limiting example, the controller 46 may adjust a voltage, a current, a duty cycle, and/or another parameter of the electrical power supplied to the drive assembly 142 (e.g., via the power supply 148) to adjust the rotational speed and/or output torque of the rotor assembly 146.

In the illustrated embodiment, the output shaft 144 includes a channel 150 (e.g., an interior passage) that extends along the axis 86 from a first end 154 toward a second end 156 of the output shaft 144. Accordingly, the channel 150 may extend along a portion of an axial length of the output shaft 144. In other embodiments, the channel 150 may extend from the first end 154 to the second end 156 of the output shaft 144, such that the channel 150 extends along and through all of the length of the output shaft 144 (e.g., through hole). In any case, as discussed in detail below, the channel 150 may be configured to receive the shaft 84 (e.g., ball screw, lead screw, threaded shaft) and enable the shaft 84 to translate axially along the output shaft 144 during operation of the first PDD motor 62.

In the illustrated embodiment, the shaft 84 includes a coupler 162 that facilitates coupling the piston button 82 to the shaft 84 and/or that blocks rotation of the shaft 84 about the axis 86 (e.g., via mating features). In some embodiments, the coupler 162 may be formed integrally with the shaft 84. In other embodiments, the coupler 162 may include a separate component that is coupled to the shaft 84 via suitable fasteners, an interference fit, or a metallurgical process, such as welding or brazing. In any case, the coupler 162 may include a first set of mating features 164 (e.g., grooves) that are disposed on an outer circumference 166 of the shaft 84 (e.g., along an outer circumference of the coupler 162) and are configured to engage with a second set of mating features 168 (e.g., keys, protrusions) disposed on an inner circumference of an axial bore 170 extending through the bracket 130. The first and second sets of mating features 164, 168 may enable the shaft 84 to translate axially (e.g., in the first and second directions 94, 96) along the axis 86, while substantially blocking rotational motion the shaft 84 about the axis 86.

In some embodiments, the motion conversion mechanism 90 may include a ball screw assembly 180 that is coupled to the output shaft 144. The ball screw assembly 180 may include a ball nut 182 that is configured to rotate with the output shaft 144 about the axis 86. The ball nut 182 supports a plurality of balls 184 (e.g., ball bearings) that are disposed between the ball nut 182 and exterior threads 186 extending about the outer circumference 166 of the shaft 84. The balls 184 are configured to engage with and travel along the exterior threads 186 and along interior threads 188 of the ball nut 182. Engagement between the balls 184, the exterior threads 186, and the interior threads 188 enables the ball screw assembly 180 to convert rotational motion of the output shaft 144 (e.g., about the axis 86) to linear movement of the shaft 84 (e.g., along the axis 86).

For example, during operation of the BOP 40, the controller 46 may instruct the first PDD motor 62 to rotate (e.g., via the rotor 88) the output shaft 144 and the ball screw assembly 180 about the axis 86 and about the shaft 84 (e.g., in a first direction, such as a clockwise direction 190). As set forth above, engagement between the first and second sets of mating features 164, 168 may block rotational motion of the shaft 84 about the axis 86 and with the rotor 88. Relative rotational motion between the ball screw assembly 180 and the shaft 84 may cause the balls 184 to travel along the exterior and interior threads 186, 188 to force the shaft 84 in an axial direction along the axis 86. For example, in some embodiments, when the ball screw assembly 180 rotates in the clockwise direction 190 about the axis 86, relative to the shaft 84, the balls 184 may force the shaft 84 in the first direction 94 along the axis 86. Conversely, when the ball screw assembly 180 rotates in a second direction, such as a counter-clockwise direction 192, about the axis 86, relative to the shaft 84, the balls 184 may force the shaft 84 in the second direction 96 along the axis 86. To this end, the ball screw assembly 180 enables the first PDD motor 62 to selectively force the shaft 84 in the first or second directions 94, 96 along the axis 86, such that the shaft 84 may force (e.g., via the piston button 82) the first ram 50 into the bore 25 or withdraw the first ram 50 from the bore 25. It should be understood that the shaft 84 may translate out of or into the channel 150 when the motion conversion mechanism 90 forces the shaft 84 in the first direction 94 or the second direction 96, respectively.

Notably, the first PDD motor assembly 60 may enable actuation of the first ram 50 without utilization of a gearbox assembly (e.g., mechanical gears). Indeed, the first PDD motor 62 may be directly coupled to the shaft 84 via the motion conversion mechanism 90 (e.g., via the ball screw assembly 180). The first PDD motor 62 may be operable to apply a torque to the output shaft 144 that enables the ball screw assembly 180 to force the shaft 84 and the first ram 50 in the first direction 94 with sufficient force to enable the first ram 50 to engage with the second ram 52 and sever the tubular 24 that may be disposed within the bore 25 and/or to maintain a seal across the bore 25.

In other embodiments, the first PDD motor assembly 60 may include a gearbox assembly (e.g., a planetary assembly) configured to increase an upper torque threshold that may be output by the first PDD motor 62. For example, in such embodiments, a planetary gearset may be positioned between and coupled to the output shaft 144 and the ball screw assembly 180, such that the planetary gearset may increase an effective upper torque threshold that may be transferred from the first PDD motor 62 to the ball screw assembly 180 during operation of the BOP 40.

It should be appreciated that the motion conversion mechanism 90 may include any other suitable mechanism or device in addition to, or in lieu of, the ball screw assembly 180, which is suitable for converting rotational motion of the output shaft 144 (e.g., about the axis 86) to linear movement of the shaft 84 (e.g., along the axis 86). As an example, in some embodiments, the motion conversion mechanism 90 may include a set of internal threads that extend along an inner circumference 198 of the channel 150 and are configured to engage with corresponding external threads formed on the outer circumference 166 of the shaft 84 (e.g., a threaded shaft). To this end, the engagement between the internal threads of the output shaft 144 and the exterior threads 186 of the shaft 84 enable the rotor 88, when rotating about the axis 86 and relative to the shaft 84, to force the shaft 84 in the first or second directions 94, 96 along the axis 86.

In some embodiments, the first PDD motor assembly 60 may include one or more sensors 200 that are communicatively coupled to the controller 46 and enable the controller 46 to monitor various operational parameters of the first PDD motor assembly 60 to determine parameters of the first ram 50 such as, for example, a position of the first ram 50 within the housing 56 and/or a force applied by the first ram 50 on the tubular 24. For example, in some embodiments, the one or more sensors 200 may include an encoder 202 (e.g., a digital encoder) or other suitable sensor that is configured to monitor a rotational position of the output shaft 144 and of the rotor 88 (e.g., with respect to an initial or baseline position). The encoder 202 may be integrated with the first PDD motor 62 (e.g., disposed within the motor housing 120) or may include an external sensor that is coupled to the motor housing 120.

A pitch of the exterior threads 186 of the shaft 84 may be known and stored in the memory 48 of the controller 46. As such, the controller 46 may, based on the rotational position of the rotor assembly 146, determine an axial position of the first ram 50 within the housing 56. For example, the default configuration 54 of the first ram 50 may correspond to a baseline position of the output shaft 144 (e.g., an initial rotational orientation of the output shaft 144 with respect to the motor housing 120). During operation of the BOP 40, such as when transitioning the first ram 50 from the default configuration 54 to the engaged configuration 80 within the bore 25, the controller 46 may monitor (e.g., based on feedback received from the encoder 202) a quantity of revolutions completed by the output shaft 144 from the baseline position. The controller 46 may determine, based on the thread pitch of the shaft 84 and the quantity of completed output shaft 144 revolutions, a corresponding distance by which the motion conversion mechanism 90 axially translates the shaft 84, and thus the first ram 50, along the axis 86. As such, the controller 46 may precisely determine, control, and monitor a position of the first ram 50 (e.g., within the housing 56) during operation of the BOP 40. In certain embodiments, the position of the first ram 50 may correspond to a force (e.g., compressive force) that the first PDD motor 62 imparts on the first ram 50. Accordingly, it should be appreciated that the controller 46 may determine, control, and monitor a compressive force applied by the first ram 50 onto the tubular 24 and/or onto the second ram 52 based on the sensor feedback received from the one or more sensors 200.

In some embodiments, the one or more sensors 200 may include one or more proximity sensors 206 that enable the controller 46 to monitor a position of the first ram 50 and/or a force output of the first ram 50 in addition to, or in lieu of, the feedback provided by the encoder 202. For example, the controller 46 may be communicatively coupled to a proximity sensor 206 disposed within the output shaft 144 and configured to monitor a separation distance between an end 208 of the shaft 84 and a portion 210 (e.g., bottom) of the channel 150. In certain embodiments, the proximity sensor 206 may be disposed near the bracket 130 or another suitable portion of the mounting assembly and configured to monitor translational movement of the shaft 84 along the axis 86. In any case, the controller 46 may utilize the feedback provided by the proximity sensors 206 to determine a current position of the shaft 84 and, thus, to determine the current position of the first ram 50 within the housing 56.

Due to the threaded engagement between the ball screw assembly 180 and the shaft 84, compressive or tensile forces applied to the first ram 50 (e.g., such as generated during shearing operations on the tubular 24) may not induce rotational motion of the rotor assembly 146 about the axis 86. Accordingly, the first PDD motor assembly 60 may passively retain a resting position of the first ram 50 even when supply of electrical power to the first PDD motor 62 (e.g., from the power supply 148) is interrupted.

In certain embodiments, the controller 46 may instruct the first PDD motor 62 to execute an active, anchoring procedure that blocks axial movement of the shaft 84 and the first ram 50. For example, the controller 46 may instruct the drive assembly 142 (e.g., via supply of electrical power from the power supply 148) to generate a magnetic field that retains the rotor assembly 146 in a desired stationary position and, thus, inhibits movement of the rotor 88 and the output shaft 144 about the axis 86. As such, by blocking rotation of the rotor assembly 146, the controller 46 may retain the first ram 52 in a particular position (e.g., sealed across the bore 25; via engagement between the rotor assembly 146 and the shaft 84).

Figure 7:
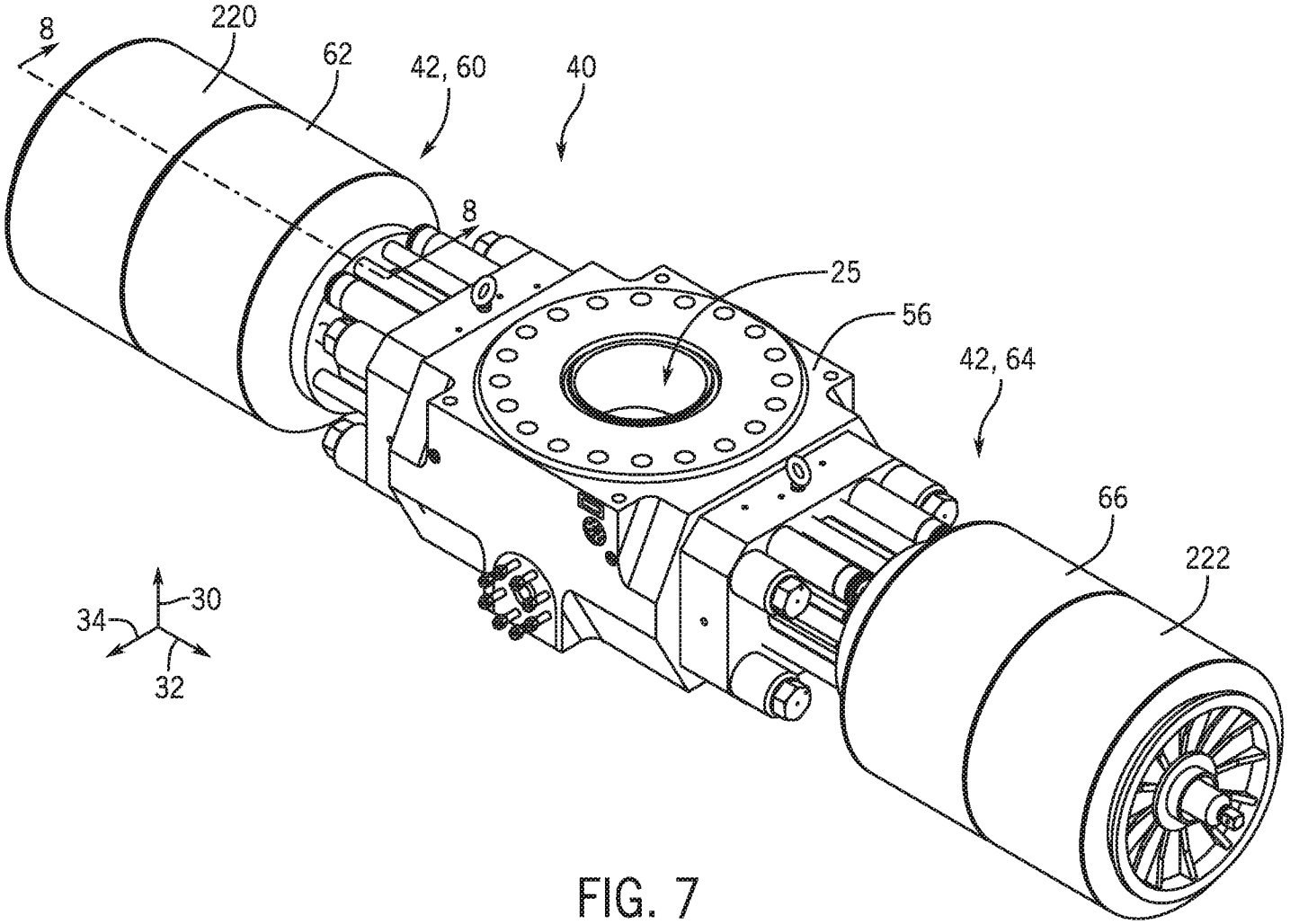
FIG. 7 is a perspective view of the BOP that may be used in the BOP stack assembly of FIG. 2, wherein the first PDD motor assembly and the second PDD motor assembly each include a plurality of PDD motors configured to drive operation of the first ram and the second ram, in accordance with an embodiment of the present disclosure.

FIG. 7 is a perspective view of another embodiment of the BOP 40, in which the which the first PDD motor assembly 60 and the second PDD motor assembly 64 each include a plurality of PDD motors. Particularly, in the illustrated embodiment, the first PDD motor assembly 60 includes the first PDD motor 62 and a third PDD motor 220 that are configured to drive operation of the first ram 50. The second PDD motor assembly 64 includes the second PDD motor 66 and a fourth PDD motor 222 that are configured to drive operation of the second ram 52. Each of the PDD motors 62, 66, 220, 222 may be communicatively coupled to the controller 46 and, as discussed in detail below, selectively controllable via instructions provided by the controller 46. Although the first and second PDD motor assemblies 60, 64 each include two PDD motors in the illustrated embodiment, it should be appreciated that, in other embodiments, the first and second PDD motor assemblies 60, 64 may include any suitable quantity of PDD motors. For example, the first and second PDD motor assemblies 60, 64 may each include 1, 2, 3, 4, 5, or more than 5 PDD motors configured to drive operation of the respective rams 50, 52.

Figure 8:
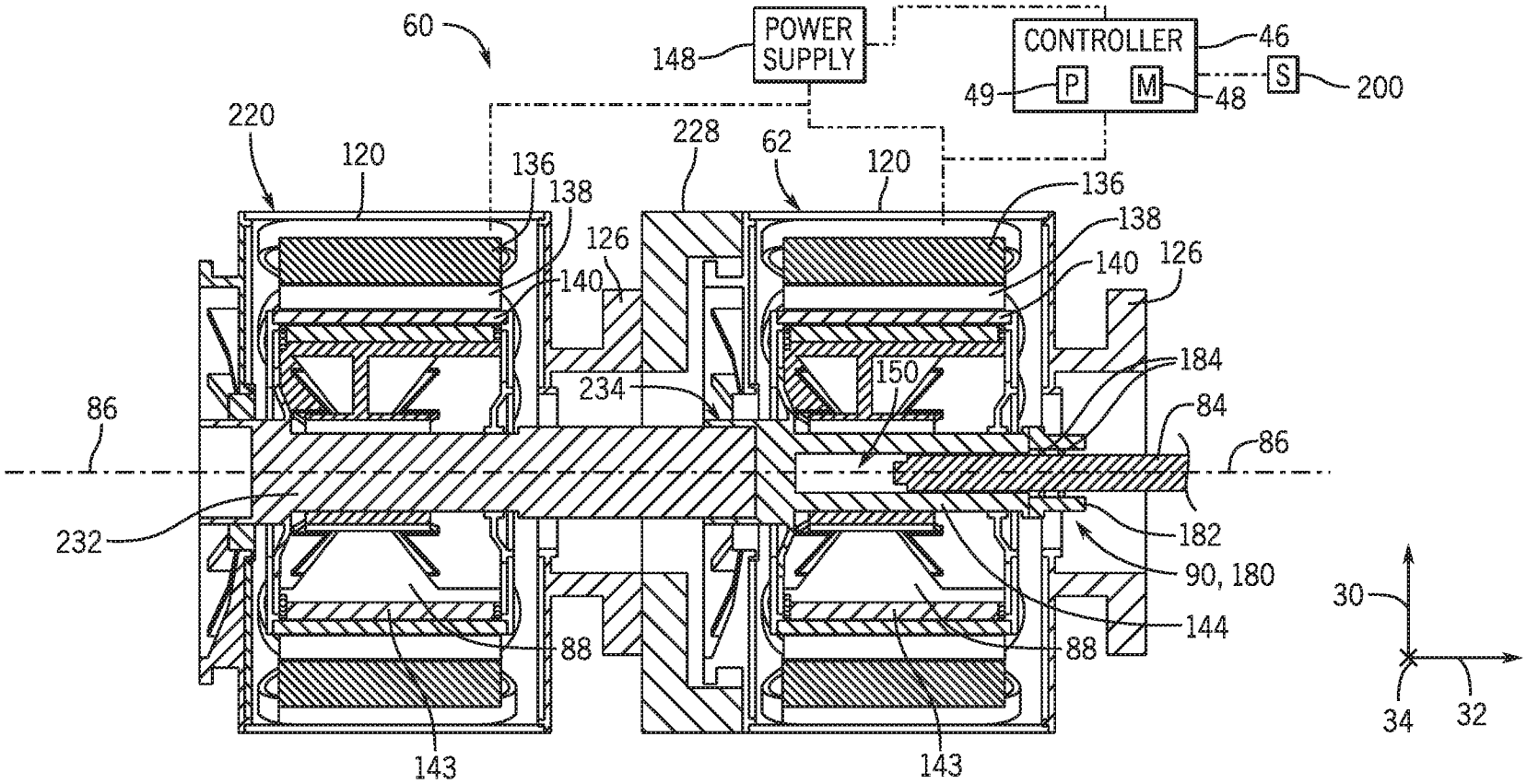
FIG. 8 is a cross-sectional side view of the first PDD motor assembly of FIG. 7 taken along line 8-8 of FIG. 7, in accordance with an embodiment of the present disclosure.

To better illustrate one of the PDD motor assemblies 42 of FIG. 7 and to facilitate the following discussion, FIG. 8 is a cross-sectional view of an embodiment of the first PDD motor assembly 60 taken along line 8-8 of FIG. 7. For clarity, it should be understood that reference numerals associated with certain components of the first PDD motor 62 may be used to identify similar components of the third PDD motor 220 in later discussion. Moreover, it should be understood that the second PDD motor assembly 64 may include some of or all of the features of the first PDD motor assembly 60 discussed herein.

As shown in the illustrated embodiment of FIG. 8, the first PDD motor assembly 60 may include an intermediate bracket 228 that facilitates coupling the flange 126 of the third PDD motor 220 to the motor housing 120 of the first PDD motor 62 (e.g., via suitable fasteners, such as bolts). In other embodiments, the motor housing 120 of the third PDD motor 220 may be configured to engage with and directly couple to the motor housing 120 of the first PDD motor 62. In any case, the third PDD motor 220 may include an additional output shaft 232 that is configured to couple to the output shaft 144 of the first PDD motor 62. For example, in some embodiments, the output shaft 144 may include a receptacle 234 formed therein, which is configured to receive the additional output shaft 232. The additional output shaft 232 may couple to the output shaft 144 at the receptacle 234 via an interference fit, fasteners, or a metallurgical process, such as welding or brazing. The engagement between the output shaft 144 and the additional output shaft 232 enables transfer or torque and rotational motion from the first PDD motor 62 to the third PDD motor 220, and vice versa. It should be appreciated that respective power output ratings (e.g., upper torque output thresholds) of the first PDD motor 62 and the third PDD motor 222 may be the same or different from one another.

In some embodiments, the controller 46 may operate the first PDD motor 62 and the third PDD motor 220 to transition the first ram 50 from the default configuration 54 to the engaged configuration 80 within the bore 25. For example, the controller 46 may simultaneously activate both the first PDD motor 62 and the third PDD motor 220 to transition the first ram 50 to the engaged configuration 80 when a blowout condition is detected.

In certain embodiments, the controller 46 may initiate movement of the first ram 50 (e.g., from the default configuration 54) using the first PDD motor 62, and may subsequently activate the third PDD motor 220 in response to detecting that a torque output of the first PDD motor 62 exceeds a threshold value. For example, the controller 46 may instruct the first PDD motor 62 to move the first ram 50 to an edge of the tubular 24 and may activate the third PDD motor 220 upon a determination that the first ram 50 begins to shear the tubular 24 (e.g., as determined based on a measured torque output of the first PDD motor 62). As such, the third PDD motor 220 may assist the first PDD motor 62 in severing tubular 24 that may be of a relatively large diameter or include a relatively large wall thickness. The controller 46 may determine the torque output of the first PDD motor 62 (e.g., in substantially real-time) based on sensor feedback acquired by the one or more sensors 200 that is indicative of a current drawn by and/or a voltage supplied to the first PDD motor 62. For example, the one or more sensors 200 may include current transducers, volt meters, ammeters, or other suitable sensors configured to monitor electrical power flow between the power supply 148 and the first PDD motor 62 and/or the third PDD motor 220.

In certain embodiments, the controller 46 may operate the first PDD motor 62, the third PDD motor 220, or both, to shear the tubular 24 based on the type of tubular 24 (e.g., drill pipe, wireline cable) disposed within the bore 25. The controller 46 may determine the type of tubular 24 disposed within the bore 25 based on sensor feedback (e.g., acquired via one of the one or more sensors 200 that may be disposed within the bore 25) and/or a signal (e.g., user input) received from an user interface of an operator of the drilling system 10. For example, the controller 46 may operate the first PDD motor 62 and not the third PDD motor 220 while a first type of tubular 24 (e.g., relatively small or thin-walled) is within the bore 25, and the controller 46 may operate both the first PDD motor 62 and the third PDD motor 220 while a second type of tubular 24 is within the bore 25 (e.g., relatively large or thick-walled compared to the first type of tubular 24).

In some embodiments, the controller 46 may initiate operation of the third PDD motor 220 in response to detecting a fault condition of the first PDD motor 62. For example, upon receiving feedback (e.g., via the one or more sensors 200) that the first PDD motor 62 has incurred a fault during operation of the BOP 40, the controller 46 may be configured to deactivate a control signal to the first PDD motor 62 (e.g., to power down the first PDD motor 62) and to send a control signal to the third PDD motor 220 to activate the third PDD motor 220 for control of the first ram 50. As such, even when the first PDD motor 62 is inactive (e.g., non-operational due to the fault condition; incapable of adequately driving the first ram 50, such as to reach or to maintain the engaged configuration 80), the controller 46 may operate the third PDD motor 220 to facilitate severing of the tubular 24 and/or sealing the bore 25 in accordance with the techniques discussed above.

Figure 9:
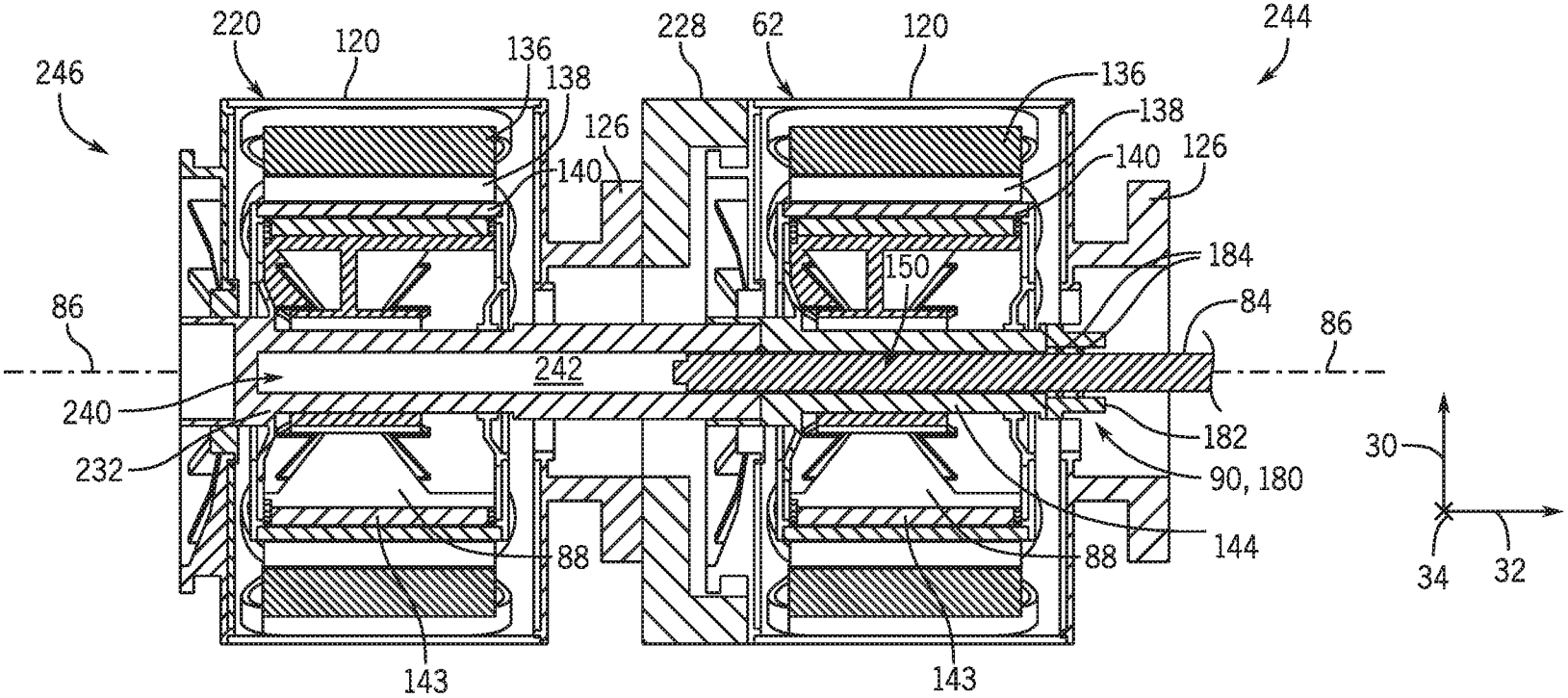
FIG. 9 is a cross-sectional side view of the first PDD motor assembly of FIG. 7, wherein the first PDD motor assembly includes an additional channel, in accordance with an embodiment of the present disclosure.

FIG. 9 is cross-sectional view of another embodiment of the first PDD motor assembly 60, in which the additional output shaft 232 includes an additional channel 240. As shown in the illustrated embodiment, the channel 150 of the output shaft 144 extends along all of a length of the output shaft 144 (e.g., through hole) and engages with the additional channel 240. As such, the channel 150 and the additional channel 240 collectively define a central passage 242 that extends along the output shaft 144 and the additional output shaft 232, from a first end portion 244 of the first PDD motor assembly 60 toward a second end portion 246 of the first PDD motor assembly 60. The shaft 84 may extend into the central passage 242 and translate along the central passage 242 during operation of the BOP 40.

Figure 10:
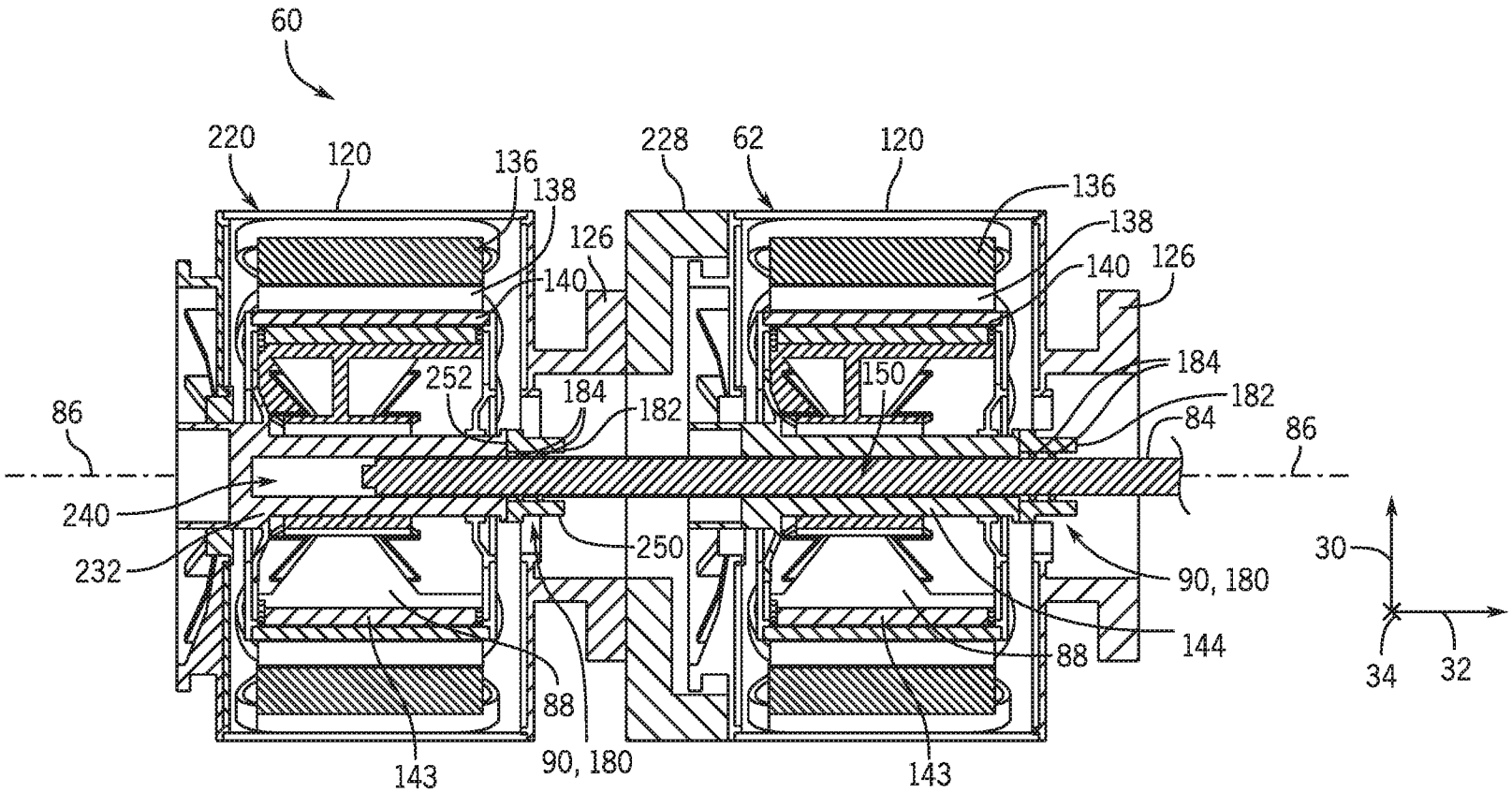
FIG. 10 is a cross-sectional side view of the first PDD motor assembly of FIG. 7, wherein each motor of the first PDD motor assembly includes a dedicated motion conversion mechanism, in accordance with an embodiment of the present disclosure.

FIG. 10 is cross-sectional view of another embodiment of the first PDD motor assembly 60, in which the first PDD motor 62 and the third PDD motor 220 each include a dedicated motion conversion mechanism 90. For example, as shown in the illustrated embodiment, the additional output shaft 232 is coupled to an additional motion conversion mechanism 250 (e.g., a ball screw assembly) that is coupled to an end 252 of the additional output shaft 232. The shaft 84 is configured to extend through the channel 150 of the output shaft 144 and into the additional channel 240 of the additional output shaft 232, such that the shaft 84 may engage with the motion conversion mechanism 90 of the first PDD motor 62 and the additional motion conversion mechanism 250 of the third PDD motor 220. As such, the additional motion conversion mechanism 250 enables the third PDD motor 220 to transfer power (e.g., torque) to the shaft 84, even though the additional output shaft 232 is not directly coupled to the output shaft 144. As an example, the additional motion conversion mechanism 250 may include the ball nut 182 and the ball 184, which enable power transfer between the additional output shaft 232 and the shaft 84 in accordance with the techniques discussed above. As such, each of the ball screw assemblies 180 may facilitate force distribution to respective surface areas (e.g., multiple regions or portions) of the shaft 84.

The following discussion continues with reference to FIG. 4. As discussed above, the controller 46 may be configured to monitor respective positions of the first and second rams 50, 52 based on feedback provided by the one or more sensors 200 (e.g., the encoder 202, the position sensors 204). In some embodiments, the controller 46 may adjust operation of the first and second PDD motor assemblies 60, 64 to ensure that the first and second rams 50, 52 retain the tubular 24 at or near a center of the bore 25 during shearing of the tubular 24 and/or sealing of the bore 25. For example, the controller 46 may be configured to continuously or intermittently (e.g., periodically) determine respective positions of the first ram 50 and the second ram 52 as the first and second rams 50, 52 move from the default configurations 54 to the engaged configurations 80 during a shearing and/or sealing operation performed on the tubular 24. The controller 46 may be configured to adjust an operational speed and/or an output torque of the first PDD motor assembly 60, the second PDD motor assembly 64, or both, to ensure that the first and second rams 50, 52 travel toward the corresponding engaged configurations 80 at substantially similar rates and engage (e.g., contact) the tubular 24 substantially concurrently. In this manner, the controller 46 may ensure that the first ram 50 or the second ram 52 do not push or otherwise lean the tubular 24 toward an edge 260 of the bore 25, such that the tubular 24 remains at or near the center of the bore 25 during shearing and/or sealing operations performed by the BOP 40. However, it should be appreciated that other shearing and/or sealing operations may be performed, such as sequentially moving the first and second rams 50, 52 (e.g., to contact and support the tubular 24 with the first ram 50, and then to move the second ram 52 into the bore 25 to contact the tubular 24).

As set forth above, embodiments of the present disclosure may provide one or more technical effects useful for enabling operation of rams of a BOP without utilization of dedicated hydraulic cylinder assemblies. Particularly, the disclosed BOP system may be devoid of various hydraulic lines, fluid reservoirs, pumps, accumulators, and/or other hydraulic components from the BOP system, which may reduce a manufacturing cost and/or a manufacturing complexity of the BOP system, as well as improve an operational reliability of the BOP system (e.g., as compared to some existing BOP systems). It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A drive system for a blowout preventer (BOP), the drive system comprising:

a first pseudo direct drive (PDD) motor assembly having a first PDD motor;

a second PDD motor assembly having a second PDD motor, wherein the first PDD motor is configured to engage with a first shaft coupled to a first ram of the BOP and the second PDD motor is configured to engage with a second shaft coupled to a second ram of the BOP, and the first PDD motor and the second PDD motor are operable to induce translation of the first shaft and the second shaft, respectively, to drive the first ram and the second ram toward one another along a longitudinal axis to reach an engaged configuration in the BOP, wherein the first PDD motor comprises:

a rotor assembly comprising: a rotor; a series of rotor magnets; and an output shaft; and a drive assembly comprising a stator, wherein the drive assembly is configured to:

generate a first magnetic field that rotates the rotor assembly about the longitudinal axis; and generate a second magnetic field that retains the rotor assembly in a stationary position, thereby inhibiting movement of the rotor and the output shaft about the longitudinal axis.

2. The drive system of claim 1, wherein the first PDD motor assembly comprises a motion conversion mechanism coupled to the output shaft and configured to engage with the first shaft, the motion conversion mechanism is configured to convert rotational motion of the rotor assembly about the longitudinal axis to axial movement of the first shaft along the longitudinal axis, such that engagement between the motion conversion mechanism and the first shaft enables the first PDD motor to translate the first ram along the longitudinal axis.

3. The drive system of claim 2, wherein the motion conversion mechanism comprises a ball screw assembly.

4. The drive system of claim 1, comprising:

a controller communicatively coupled to the first PDD motor; and a sensor configured to provide feedback indicative of a rotational position of a rotor assembly of the first PDD motor, wherein the controller is configured to determine a position of the first ram along the longitudinal axis relative to a housing of the BOP based on the feedback.

5. The drive system of claim 4, wherein the sensor is a digital encoder.

6. The drive system of claim 1, wherein the first PDD motor assembly comprises a third PDD motor coupled to the first PDD motor and configured to engage with the first shaft, the second PDD motor assembly comprises a fourth PDD motor coupled to the second PDD motor and configured to engage with the second shaft, and the third PDD motor and the fourth PDD motor are configured to induce translation of the first shaft and the second shaft, respectively, along the longitudinal axis to drive the first ram and the second ram toward one another.

7. A blowout preventer (BOP) system, comprising:

a housing defining a bore;

a first ram and a second ram positioned within the housing;

a first pseudo direct drive (PDD) motor assembly coupled to the housing, wherein the first PDD motor assembly comprises a first PDD motor coupled to the first ram via a first shaft and configured to translate the first ram along a longitudinal axis of the housing; and a second PDD motor assembly coupled to the housing, wherein the second PDD motor assembly comprises a second PDD motor coupled to the second ram via a second shaft and configured to translate the second ram along the longitudinal axis, such that the first PDD motor and the second PDD motor are operable to transition the first ram and the second ram between a default configuration to uncover the bore and an engaged configuration to form a seal across the bore, wherein the first PDD motor comprises a rotor assembly and is configured to rotate the rotor assembly about the longitudinal axis via a drive assembly, and the rotor assembly comprises: a rotor; a series of rotor magnets; and an output shaft having a channel formed therein, and wherein the first PDD motor is also configured to retain the rotor assembly in a stationary position via the drive assembly, thereby inhibiting movement of the rotor and the output shaft about the longitudinal axis.

8. The BOP system of claim 7, wherein the first PDD motor assembly comprises a motion conversion mechanism coupled to the rotor assembly, the first shaft is configured to engage with the motion conversion mechanism and extend into the channel, and the motion conversion mechanism is configured to convert rotational motion of the rotor assembly about the longitudinal axis to axial movement of the first shaft along the longitudinal axis to enable the first PDD motor to move the first ram between the default configuration and the engaged configuration.

9. The BOP system of claim 8, wherein the first shaft comprises a ball screw having threads, and the motion conversion mechanism comprises a ball screw assembly configured to engage with the threads.

10. The BOP system of claim 7, wherein the first shaft includes a first mating feature configured to engage with a second mating feature of the first PDD motor assembly, and the second mating feature is configured to enable axial movement of the first shaft along the longitudinal axis and block rotational motion of the first shaft about the longitudinal axis.

11. The BOP system of claim 7, wherein the first PDD motor assembly comprises a third PDD motor coupled to the first PDD motor and engaged with the first shaft, and the third PDD motor is configured to drive movement of the first ram along the longitudinal axis via the first shaft.

12. The BOP system of claim 11, comprising a controller communicatively coupled to the first PDD motor and the third PDD motor, wherein the controller is configured to operate the first PDD motor to drive operation of the first ram, and to activate the third PDD motor upon determining that a torque output of the first PDD motor exceeds a threshold value.

13. The BOP system of claim 7, comprising:

one or more sensors configured to acquire feedback indicative of respective positions of the first ram and the second ram within the bore; and a controller communicatively coupled to the first PDD motor and the second PDD motor and configured to adjust operation of the first PDD motor and the second PDD motor based on the feedback.

14. A blowout preventer (BOP) system, comprising:

a housing defining a bore;

a ram positioned within the housing;

a pseudo direct drive (PDD) motor assembly coupled to the housing and comprising:

a PDD motor having a rotor assembly and a drive assembly configured to rotate the rotor assembly about a longitudinal axis, wherein the rotor assembly comprises: a rotor; a series of rotor magnets; and an output shaft of the PDD motor, and wherein the drive assembly is also configured to retain the rotor assembly in a stationary position, thereby inhibiting movement of the rotor and the output shaft about the longitudinal axis;

a shaft coupled to the ram and extending along the longitudinal axis; and a motion conversion mechanism coupled to the rotor assembly and engaged with the shaft, wherein the motion conversion mechanism is configured to convert rotational motion of the rotor assembly about the longitudinal axis to axial movement of the shaft along the longitudinal axis to enable the PDD motor to translate the ram across at least a portion of the bore.

15. The BOP system of claim 14, wherein the motion conversion mechanism comprises a ball screw assembly configured to engage with threads extending about an outer circumference of the shaft.

16. The BOP system of claim 14, wherein the shaft extends into a channel formed within the output shaft.

17. The BOP system of claim 14, wherein the PDD motor is a first PDD motor, the PDD motor assembly comprises a second PDD motor having an additional rotor assembly configured to rotate about the longitudinal axis, and the additional rotor assembly comprises an additional output shaft coupled to the output shaft of the first PDD motor.

18. The BOP system of claim 17, wherein the output shaft comprises a channel and the additional output shaft comprises an additional channel coupled to the channel, wherein the shaft is configured to extend through the channel of the output shaft and into the additional channel of the additional output shaft.

* * * * *